US006431127B2

(12) United States Patent
Weber

(10) Patent No.: US 6,431,127 B2
(45) Date of Patent: Aug. 13, 2002

(54) VENTILATION DEVICE

(75) Inventor: Konrad Weber, Siersburg (DE)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 09/813,427

(22) Filed: Mar. 21, 2001

(30) Foreign Application Priority Data

Apr. 1, 2000 (DE) ..... 100 16 435

(51) Int. Cl.[7] ..... F01P 7/04
(52) U.S. Cl. ..... 123/41.12
(58) Field of Search ..... 123/41.12

(56) References Cited

U.S. PATENT DOCUMENTS 4,738,330 A * 4/1988 Suzuki et al. ..... 123/41.12

5,165,377 A * 11/1992 Hosseini ..... 123/41.12

* cited by examiner

*Primary Examiner*—Gene Mancene
*Assistant Examiner*—Hyder Ali

(57) ABSTRACT

A ventilation device of an agricultural vehicle such as a combine, forage harvester or tractor having an engine (10) and a cooling device (12) for cooling the engine (10) and/or additional parts to be cooled that are in a heat conducting relationship. The ventilation device comprises a fan (20) a fan drive (18) and a control system (26) connected to the fan drive (18) to regulate the feeding rate of the fan (20). The control system (26) is arranged to control the fan drive (18) in the most energy-efficient way while making allowance for the amount of ambient air required by the cooling device (12) and the drive power requirements of the fan (20) using a flat logic (fuzzy control).

5 Claims, 2 Drawing Sheets

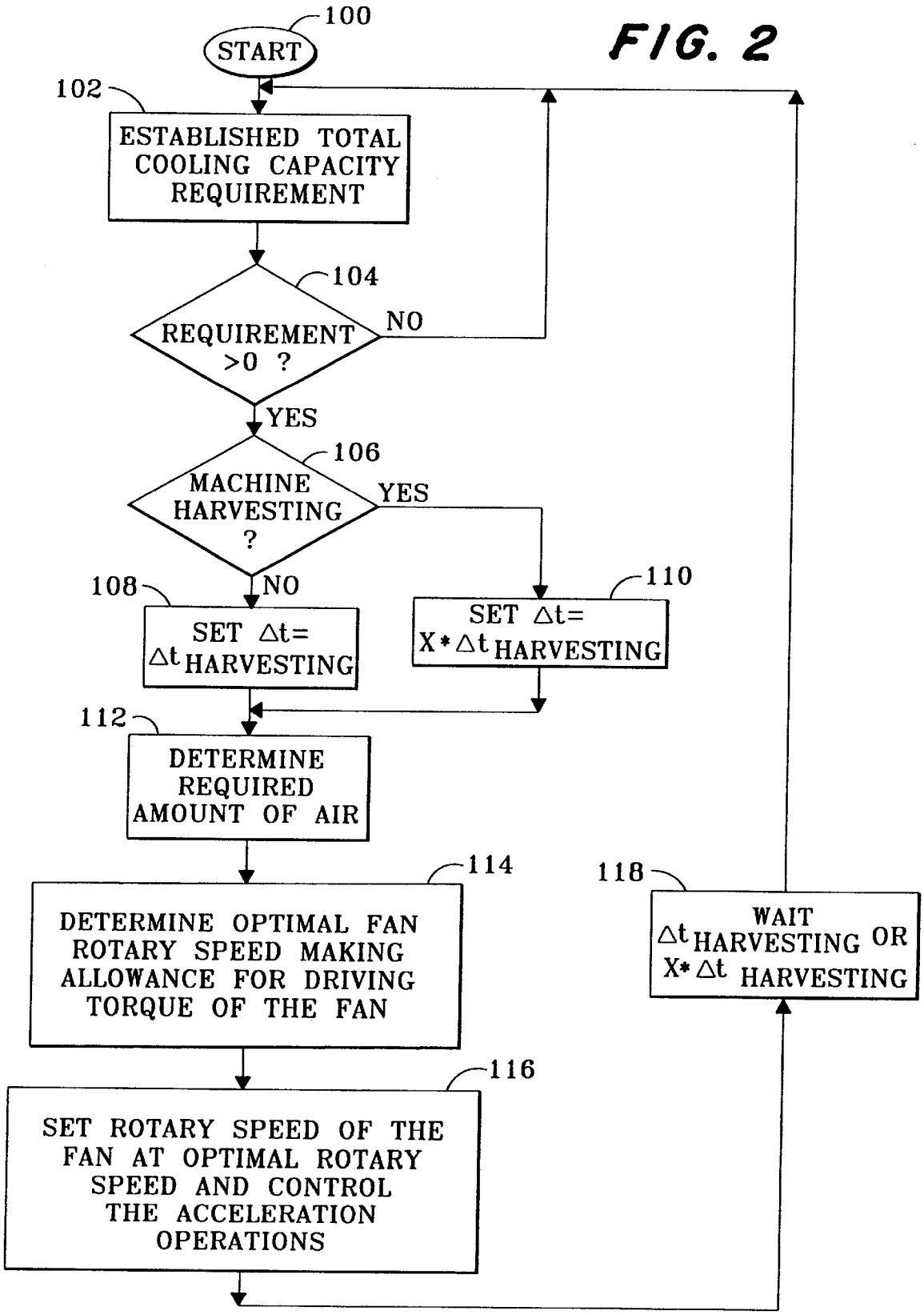
FIG. 2
100
START
102
ESTABLISHED TOTAL COOLING CAPACITY REQUIREMENT
104
REQUIREMENT >0 ?
NO
YES
106
MACHINE HARVESTING ?
YES
NO
108
SET Δt= Δt HARVESTING
110
SET Δt= X*Δt HARVESTING
112
DETERMINE REQUIRED AMOUNT OF AIR
114
DETERMINE OPTIMAL FAN ROTARY SPEED MAKING ALLOWANCE FOR DRIVING TORQUE OF THE FAN
116
SET ROTARY SPEED OF THE FAN AT OPTIMAL ROTARY SPEED AND CONTROL THE ACCELERATION OPERATIONS
118
WAIT Δt HARVESTING OR X*Δt HARVESTING

VENTILATION DEVICE

BACKGROUND OF THE INVENTION

The invention pertains to a ventilation device of a vehicle such as an agricultural vehicle, which has an engine and a cooling device, with which the engine and/or additional parts to be cooled are in a heat conducting relationship, while the ventilation device comprises a fan with a fan drive, by means of which ambient air is fed to the cooling device, and a control system connected to the fan drive, which is provided to regulate the air feed rate of the fan.

Known from U.S. Pat. No. 4,828,088 A is a ventilation device for use in trucks or automobiles, in which a control system with sensors for the temperature of the vehicle engine and the respective speed, is provided. By means of a viscous coupling, the rotary speed of a fan is adjusted in such a way that the engine is adequately cooled but the lowest possible energy requirement and a minimal noise generation are achieved.

Disclosed in U.S. Pat. No. 5,584,371 A is a similar ventilation device. Here the speed of a fan is regulated in relation to the temperature of the coolant and the rotary speed of the engine. In the normal operating range, the rotary speed of the fan is proportional to the rotary speed of the engine.

In the field of self-propelled harvesters, a tendency to ever-increasing engine power can be observed. Since the speed of these machines is often very low during the harvesting process and the rotary speed of the engine is comparatively high, suitable measures must be taken to cover the cooling output requirements. In addition, cooling output must be provided for a number of other systems. Consequently, the capacity for heat dissipation is, as a rule, made available by the air feeding capacity of large fans.

Inasmuch as known control devices for rotary speed of fan have not proven to be expedient in actual practice, e.g., due to high shifting frequencies and uncontrolled acceleration occurrences, fixed fan drives are generally in use at the present time. However, as a rule, the output requirement of fan increases with the square of drive motor speed and, depending upon the fan type, reaches as high as 10% of the total engine output at high engine rotary speeds. In many cases, e.g., in roadway driving—which can constitute as much as 30% of the machine operation— only a part of this fan output is really needed, so that the energy consumption of the harvester is unnecessarily high.

The problem underlying the invention is to make available an improved ventilation device.

SUMMARY OF THE INVENTION

The solution according to the invention makes allowance for two essential values as initial parameters: the requirement of the cooling device for ambient air and the feeding rate of the fan. In the light of these parameters, the feeding rate of the fan is adjusted in such a way that it is operated in a manner that maximizes energy-savings yet covers the cooling requirement. Thus, in keeping with the invention, allowance is made by the control system for both the requirement of the cooling device for ambient air and the operating energy of the fan. In particular, the control system makes it possible to execute the acceleration operations of the fan in a controlled manner.

In this way, an energy-saving ventilation device which lowers the fuel consumption and the operating costs of the vehicle is obtained. Furthermore, the disturbing noises of the fan, e.g., when the vehicle is operated on the roadway, are reduced to a minimum level. By virtue of the control system, it is possible to install a given fan on vehicles of various cooling requirements, since the feeding rate of the fan commensurately controls the respective requirement. Thereby the number of different parts which must be made ready for the production of various vehicles is reduced.

The control system specifically allows for the load moment of the fan dependent upon the quantitative feed, i.e., the relationship between the driving torque (or the driving power) and the respectively fed quantity of air. In addition, the moment of inertia of the fan is allowed for, which represents the energy for accelerating the fan to the rotary speed corresponding to the respective quantitative feed. Thus the control system is charged with information as to how much energy is required to accelerate the fan to a certain rotary speed (representing a certain quantitative feed). In this manner it is possible to make allowance for the "costs" of a change, especially an increase, of the feeding rate of the fan, when determining the feeding rate. Unnecessary rotary speed changes, which also place undue mechanical stress upon both the fan and the fan drive, are then reduced to a minimum. Allowance can also be made for the moments of loss of the fan; they are usually due to friction or slipping. With the energy-saving selection of the feeding rate, it is also possible to ensure that the engine does not unnecessarily heat up due to the driving torque build-up required for the fan.

It is additionally proposed that the control system calculate the requirement of the cooling device for a predetermined period of time and adjust the fan drive to a constant feeding rate for this period. A reasonable period of time is, e.g., one minute.

In order to determine the given requirement of the cooling device for ambient air, the control system can be connected to one or more sensors. In this manner, it is possible to monitor the temperature of the ambient air, the temperature of a coolant of the cooling device, the temperature of a hydraulic fluid and the rotary speed of the engine. Furthermore, the rotary speed or the feeding rate of the fan can be monitored, so that it can be compared with the reference value calculated by the control system and adjusted as necessary.

The control system can be equipped with a flat logic. Such logics are known and produce association functions for one or more input variables for the control system and determine, by way of a regulator, output values, with which the feeding rate of the fan is adjusted.

The opportunity of designing the feeding rate to be continuous, i.e., infinitely variable, presents itself, although a stepped adjustment would also be plausible, which is realizable, e.g., with a transmission with several gear settings. For the continuous adjustment of the feeding rate, hydraulic transmissions or so-called CVT transmissions (continuous variable transmission) present themselves. The latter are known from the automobile industry and have a drive belt running around two belt pulleys. One of the belt pulleys is conical and the drive belt is so arranged as to be laterally adjustable thereon. A hydraulic drive consists of a pump with an adjustable feeding output and a hydraulic motor. The use of a viscous coupling is also plausible, as described in the US patent documents cited above.

BRIEF DESCRIPTION OF THE DRAWINGS

FIG. 2 is a flow chart, according to which the control system works.

DETAILED DESCRIPTION OF THE PREFERRED EMBODIMENT

Figure 1:
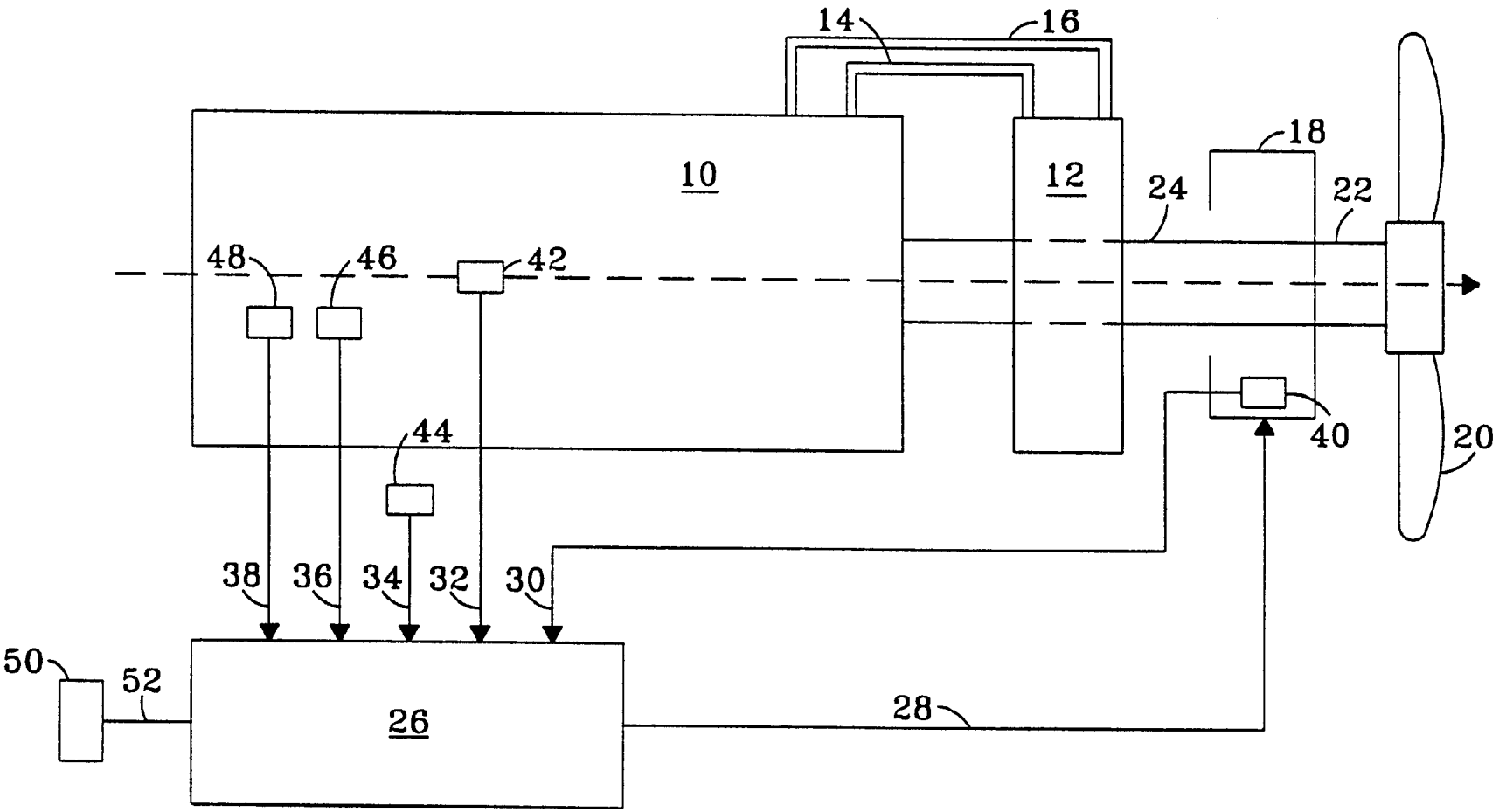
FIG. 1 is a schematic of a ventilation device according to the invention.

The ventilation device shown in FIG. 1 can be used on a farm machine or an agricultural vehicle, such as a self-propelled forage harvester, a combine or a tractor. An engine 10 of the vehicle is a combustion engine which, as a rule, is the main engine and serves to propel the vehicle, is connected to a cooling device 12 by a coolant input line 14 and a coolant return line 16. The coolant circulating in the coolant lines 14, 16 is, e.g., water. The engine can drive other additional parts, such as material processing mechanisms e.g., threshing or chopping devices, and/or an air conditioner. The heat given off by these mechanisms can be diverted into the ambient air by the cooling device 12 or an additional cooling device located near the cooling device 12.

Ambient air is fed to the cooling device 12 by a ventilation device comprising a propeller-type fan 20, a fan drive 18 and a control system 26 for the fan drive 18. The ambient air flows through or around the cooling device 12 and carries the dissipated heat of the engine 10 to the environment. In case additional cooling devices are present for removing the dissipated heat of the additional mechanisms cited above, ambient air is also fed to them by the fan 20. The mechanical drive of the fan 20 is accomplished by a shaft 24 connected to both the engine 10 and the fan drive 18. The fan drive 18 can be remotely controlled electronically by the control system 26 via a control system circuit 28 and establishes the rotary speed and therefore the feeding rate, or air flow rate, of the fan 20. The fan drive 18 can be realized in the form of a viscous coupling or a mechanical CVT transmission, so that the feeding rate of the fan is variable between standstill and a maximum value. The fan drive 18 is connected to the fan 20 by an additional shaft 22.

The control system 26 has a total of five variable inputs. The first input 30 is connected to a sensor 40, which is located on the fan drive 18 and acquires the rotary speed of the fan 20. This input 30 serves to monitor whether or not the rotary speed of the fan prescribed by the control system 26 is maintained and can, in case of deviation, provide the operator of the vehicle with a commensurate warning. Alternatively or additionally, the value present at the input 30 can serve as a feedback value for regulating the rotary speed of the fan.

The second input 32 of the control system 26 is connected to a sensor 42 for acquiring the rotary speed of the engine 10. The third input 34 is connected to a sensor 44 for acquiring the temperature of the ambient air, which is normally located near the fan 20 and upstream thereof. The fourth input 36 of the control system 26 is connected to a sensor 46, which acquires the temperature of a hydraulic fluid circulating in a hydraulic layout driven by the engine 10. Finally, the fifth input 38 of the control system 26 is connected to a sensor 48, which acquires the temperature of the coolant of the motor 10 circulating in the coolant lines 14, 16. Thus the control system 26 is provided with information regarding three temperatures, the rotary speed of the main engine 10 and the rotary speed of the fan 20. Also plausible would be a temperature sensor positioned at the exit from the cooling device 12 and connected to the control system 26, in order to measure the temperature of the air that has flowed past the cooling device 12. Another sensor 50 produces an input 52 to the control system 26 monitors the operational status of a material processing device, e.g., a thresher or a chopper device. During a harvesting operation, the necessary cooling capacity is generally greater than during a transport operation, which can be taken into account in the control of the fan drive.

With reference to the flow chart depicted in FIG. 2, the functioning of the control system is explained in greater detail below.

After the start in step 100 (e.g., after engaging the engine 10), the total cooling capacity requirement is determined in step 102. This consists of the cooling requirements of the component systems (here: the motor 10 and the hydraulic layout). The total requirement is the sum of the cooling capacity requirements of the component systems. Based on the temperature of the coolant (sensor 48 at input 38), the temperature of the hydraulic fluid (sensor 46 at input 36) and the reference or maximum temperatures for the coolant and the hydraulic fluid stored in a memory in the control system 26, the respective difference between the existing temperature and the reference temperature is calculated. If the difference is zero or negative, no cooling is necessary and the fan 20 can remain at rest. Therefore, in step 104 a commensurate inquiry is carried out; if the requirement is not greater than zero, step 102 is repeated, otherwise step 106 ensues.

In step 106 an inquiry is made as to whether the machine is harvesting. To this end, the sensor 50 provides an input 52 regarding the operating state of a material processing device (chopper or thresher device) or the setting of a comparable switch with which the material processing device is controlled. Alternatively, if the controller 26 is also used to control the material processing device, the input as to the status of the material processing device may be internal to the controller 26. When there is no harvesting action, step 108 ensues, in which the parameter $\Delta t$, which determines the time span in which the reference or maximum temperature should be reached, is set at a predefined value $\Delta t_{harvesting}$. If it is determined in step 106 that harvesting is underway, step 110 ensues, in which the parameter $\Delta t$ is set at the value $x \cdot \Delta t_{harvesting}$. The parameter x is selectable and is as a rule less than 1, since the dissipated energy of the engine is greater when harvesting than in roadway travel and therefore the required cooling capacity must be made ready more quickly. Nevertheless, cases are also plausible in which x is greater than 1.

Subsequently, based on the temperature differences and the ambient air temperature (sensor 44 at input 34), the determination is made in step 112 as to the amount of air necessary to be fed in order to offset the temperature difference. In this step 112 it can be meaningful to measure both the temperature of the ambient air in front of the fan 20 and the temperature of the air that has flowed past the cooling device 12. In this manner—and in consideration of the known air flow rate of the fan 20—the quantity of the dissipated heat can, in each instance, be determined as a function of the temperature of the coolant and the ambient air temperature. Therefrom it is possible to determine the quantity of air that is required to dissipate a certain amount of heat from the cooling device 12. When one knows the temperatures and the quantity of ambient air needed to dissipate a certain (uniform) amount of heat, calculation of the given amount of ambient air required is possible. It would also be plausible to store in the control system a mathematical function or a characteristic curve or table in which respective temperatures of the engine and the hydraulic fluid and the ambient air (or differences) are stored, and which contains information regarding the respective quantity of ambient air to be fed. In this manner, the amount of air to be supplied by the fan 20 is determined. The quantity of air is determined using the following equation:

$$\Delta V(\omega)/\Delta t = M/(\Delta t)$$

in which V is the volume and ΔV its change, ω is the angular frequency (rotational speed) of the fan, M is the air mass, ρ is the density of the air and Δt is the time in which the given quantity of heat is to be dissipated.

In the ensuing step 114, the optimal rotary speed of the fan is determined. As a rule, the relationship between rotary speed and feeding rate is known. It can be mathematically approximated using polynomials. With a given time Δt, in which the required amount of air calculated in step 112 is to be supplied, the rotary speed can be determined. Here the value Δt is of fundamental significance for the efficiency of the ventilation device, since the rotary speed of the fan 20 is all the greater the lower the value Δt is, since then the quantity of air can be supplied in a shorter time. If the selected value is too low, the efficiency of the ventilation device is no longer obtained; if it is too great, the rotary speed selected is too low and too much time is required until the desired temperatures are reached. It is recommended that the parameter Δt be set, e.g., at a value of 60 seconds, which means that the calculated cooling energy should be ready in 60 seconds. However, the value At can be kept randomly selectable in the control system 26.

In step 114, allowance is made for the efficiency of the operation of the fan 20. Its driving torque is composed of the actual load moment of the fan (dependent upon the rotary speed of the fan and therefore the fed quantity of air), the moment of inertia (relevant for acceleration operations) and the sum of the various moments of loss:

$$\tau = P(\omega)/\omega + J \cdot d\omega/dt + \tau_{losses}$$

in which T is the driving torque of the ventilator, P is the load moment resulting from the feeding of the air, w is the angular frequency of the fan, J is its moment of inertia and $T_{losses}$ is the (constant) moments of loss due primarily to friction.

From this it can be concluded that, in respect to efficient drive control, abrupt acceleration operations are to be avoided to the extent possible. The driving torque can be mathematically determined by the control system 26 using appropriate equations (or tables); alternatively, the use of an appropriate sensor on one of the shafts 22 or 24 is also feasible. Efforts should also be made to keep the fan rotary speed calculated in step 114 as low, but also as constant, as possible.

In step 116, the rotary speed of the fan is set at the calculated rotary speed. Here any acceleration operations are carried out by the control system. Following step 118, in which the delay time Δt is observed, step 102 is repeated. The depicted control system 26 also permits rotary speed reductions of the fan (in case of continuing negative requirement), and corrects the rotary speed accordingly in steps 112 and 114.

It should be noted that in the embodiment of the invention illustrated in FIG. 2, no allowance is made for changes of the fed quantities of air resulting from acceleration or slowing of the fan. However, provisions can also be made therefor in the embodiment form according to FIG. 2 in the step 114.

The control system 26 can execute steps 102-118 by means of a flat logic (fuzzy control), since a classic, linear control system would require a great calculation capacity. The flat logic is based on mathematic equations representing steps 104 and 108.

The invention should not be limited to the above-described embodiment, but should be limited solely by the claims that follow.

What is claimed is:

1. A method of controlling a variable speed fan drive for a vehicle cooling fan of a vehicle having at least one component system that requires cooling including an engine, a cooling device, a fan for moving ambient air through the cooling device, a fan drive and a control system connected to the fan drive to regulate the feeding rate of the fan, the method comprising the steps of:

determining the total cooling capacity requirements of the component systems;

if the total cooling requirement is greater than zero, determine the amount of air flow through the cooling device to meet the total cooling capacity requirement in a first predefined time period;

determining the optimum fan rotary speed necessary to achieve the amount if air flow determined in the previous step while considering the fan moment of inertia to minimize the fan acceleration torque load;

setting the fan rotary speed at the speed determined in the previous step and controlling the acceleration of the fan speed as determined in the previous step; and waiting the first predefined time period and repeating the above steps.

2. The method as defined by claim 1 wherein while determining the fan rotary speed necessary to achieve the determined amount of air flow, the load moment of the fan and the moments of loss of the fan are also considered.

3. The method as defined by claim 1 wherein the controller determines a constant fan speed for the predefined time period.

4. The method as defined by claim 1 wherein the controller receives an input signal indicative of a harvesting operational mode if the vehicle and, when the vehicle is in a harvesting operational mode, the first predefined time period is modified by a factor x to calculate a second predefined time period; and determining the amount of air flow through the cooling device to meet the total cooling capacity requirement in the second predefined time period and waiting the second predefined time period before repeating the process.

5. The method as defined by claim 1 wherein the controller has a flat logic which generates association functions for one or more input variables of the control system and determines output values with which the feeding rate of the fan is adjusted.

* * * * *